US006236374B1

(12) United States Patent
Nordin

(10) Patent No.: US 6,236,374 B1
(45) Date of Patent: May 22, 2001

(54) ANTENNA ARRANGEMENT FOR TRANSMITTING AT LEAST TWO FREQUENCIES USING A SINGLE ANTENNA

(75) Inventor: Sven Nordin, Haninge (SE)

(73) Assignee: Televerket, Farsta (SE)

( * ) Notice: Subject to any disclaimer, the term of this patent is extended or adjusted under 35 U.S.C. 154(b) by 0 days.

(21) Appl. No.: 08/380,444

(22) Filed: Jan. 30, 1995

Related U.S. Application Data

(63) Continuation of application No. 08/025,062, filed on Mar. 2, 1993, now abandoned.

(30) Foreign Application Priority Data

Mar. 19, 1992 (SE) ..... 9200845

(51) Int. Cl.[7] ..... H01Q 13/12; H01Q 5/00
(52) U.S. Cl. ..... 343/729; 343/770
(58) Field of Search ..... 343/729, 790, 343/791, 767.77, 825; H01Q 5/00, 9/30, 13/12

(56) References Cited

U.S. PATENT DOCUMENTS

| | | | | |
|---|---|---|---|---|
| 2,479,227 | * | 8/1949 | Gilbert | 343/729 |
| 2,947,988 | | 8/1960 | Masters . | |
| 2,971,193 | | 2/1961 | Siukola . | |
| 2,996,718 | | 8/1961 | Foley . | |
| 3,945,013 | * | 3/1976 | Brunner et al. | 343/729 |
| 4,095,229 | | 6/1978 | Elliott . | |
| 4,197,549 | | 4/1980 | Collins . | |
| 4,247,858 | * | 1/1981 | Eichweber | 343/729 |
| 4,297,707 | * | 10/1981 | Brunner et al. | 343/725 |
| 4,748,450 | | 5/1988 | Hines et al. . | |
| 4,968,991 | | 11/1990 | Yamazaki . | |
| 5,017,935 | | 5/1991 | Hayashi et al. . | |
| 5,072,232 | | 12/1991 | Korner . | |

FOREIGN PATENT DOCUMENTS

| | | |
|---|---|---|
| 0 195 356 | 9/1986 | (EP) . |
| 0 323 726 | 7/1989 | (EP) . |
| 0 350 308 | 1/1990 | (EP) . |
| 0 406 564 | 1/1991 | (EP) . |
| 0 429 255 | 5/1991 | (EP) . |
| 747 505 | 4/1956 | (GB) . |
| 1 446 999 | 8/1976 | (GB) . |
| WO 86/06216 | 10/1986 | (WO) . |

OTHER PUBLICATIONS

Moxon, "HF Antennas For All Locations", published by RSGB, Pitman Press, Bath, 1984, pp. 114,115,161 and 162.*

* cited by examiner

*Primary Examiner*—Michael C. Wimer
(74) *Attorney, Agent, or Firm*—Oblon, Spivak, McClelland, Maier & Neustadt, P.C.

(57) ABSTRACT

An antenna arrangement for transmitting at least two frequencies over a single antenna element, the length of which is selected as a fraction, for example, 5/8ths, of the wavelength of the lower of the said at least two frequency. The higher frequencies are transmitted via slots formed in the wall of the waveguide forming the antenna element. The antenna element is in the form of, at least, a semi-rigid structure which includes a waveguide antenna formed integrally with a waveguide feed line to provide a single waveguide unit, the internal structure of the single waveguide unit being used as a waveguide for the higher frequencies which are transmitted via the slots in the wall of the waveguide.

9 Claims, 2 Drawing Sheets

ANTENNA ARRANGEMENT FOR TRANSMITTING AT LEAST TWO FREQUENCIES USING A SINGLE ANTENNA

This application is a Continuation of application Ser. No. 08/025,062, filed on Mar. 2, 1993, now abandoned.

BACKGROUND OF THE INVENTION

The invention relates to an antenna arrangement in which at least two frequencies can be transmitted by means of a single antenna.

In the mobile radio communication field, there is a need to be able to transmit signals in different frequency bands. Furthermore, it is desirable, in satisfying this need, to be able to use a single antenna arrangement. An antenna arrangement for transmitting AM/FM and microwave, is described in U.S. Pat. No. 4,968,991. The solution described in U.S. Pat. No. 4,968,991 can, at most, be utilised for frequencies up to 3 GHz. This antenna arrangement also comprises inner and outer conductors and tubes.

The requirement for transmitting several frequencies in, for example, mobile radio traffic, is combined with the requirement of speech communication and, respectively, the transmission of traffic information. It is intended to transmit traffic information in a higher frequency band than the one utilised for normal radio communication.

It is possible to arrange different antennas for different frequencies. These antennas can be placed, for example, on the roof of a vehicle, such as a car, on its rear view mirrors, or at the front of the vehicle. When microwaves are transmitted by an antenna, it is desirable that the range is limited. This can be done, for example, by mounting the antenna element at the front of the vehicle. One difficulty with such an arrangements is that both the antenna element and the feed line for the antenna element become soiled by dirt, and the like, from the roadway. Soiling causes shielding of the radio waves and thereby gives rise to impaired transmission efficiency for the antenna. There is, therefore, a requirement for an antenna arrangement for vehicles, which is not affected by dirt from the roadway.

It is considered that frequencies in the GHz range are suitable for the transmission of traffic information. The relevant frequency ranges are of the order of 10 GHz and higher.

It is an object of the present invention to provide an antenna arrangement for simultaneously transmitting UHF and the X and K frequency bands utilizing a single coaxial antenna arrangement. Antenna arrangements adapted for transmission in the 10 GHz frequency range have not, hitherto, been available.

SUMMARY OF THE INVENTION

The present invention provides an antenna arrangement for transmitting at least two frequencies comprising a waveguide antenna element that is of a length matched to a fraction of the wavelength of the lower of the said at least two frequencies, that is short circuited at one end thereof, and that has slots formed in the wall of the waveguide, at the short circuited end thereof, for the transmission of the higher of the said at least two frequencies; first waveguide means for feeding the said higher frequency directly to the antenna element at the other end thereof; and second waveguide means for capacitively coupling the said lower frequency to the antenna element.

According to one aspect of the present invention, the first waveguide means include a first waveguide feed line, which is formed integrally with the antenna element to provide a single waveguide unit, the internal structure of the single waveguide unit being used as a waveguide for the higher frequencies that are transmitted via the slots in the wall of the waveguide.

According to another aspect of the present invention, the second waveguide means include a second waveguide feed line, and a capacitor connected between the antenna element and one end of the second waveguide feed line.

According to a further aspect of the present invention, the said other end of the antenna element is at earth potential.

With the present invention, no special balun or high-pass filter is required for feeding the higher frequencies to the antenna arrangement.

An advantage of the present invention is that it provides a very simple and inexpensive antenna arrangement.

Furthermore, it is possible with the present invention to transmit frequencies in excess of 3 GHz, which, as stated above, is probably the highest frequency that can be transmitted by known antenna arrangements.

The antenna arrangement according to the present invention is adapted to transmit frequencies up to the range of 100 GHz, the higher frequencies transmitted by the antenna element being greater than 1 GHz.

The foregoing and other features according to the present invention will be better understood from the following description with reference to FIG. 1 of the accompanying drawings, which illustrates an antenna arrangement according to the invention that is adapted to transmit at least two frequencies and has an antenna of a length that is matched to a fraction, for example, ⅝ths, of the wavelength of the lowest of the said at least two frequencies.

BRIEF DESCRIPTION OF THE DRAWINGS

In the following text, an antenna arrangement is described which operates, partly with UHF, and partly with the X and K bands.

As illustrated in FIG. 1 of the drawings, the antenna arrangement according to the present invention includes an antenna element l which is permanently secured to a support member 7, for example, the roof of a vehicle, such as a car. At least two frequencies that the antenna arrangement is adapted to transmit, are fed into the antenna by means of separate antenna leads 5 and 6.

Figure 1:
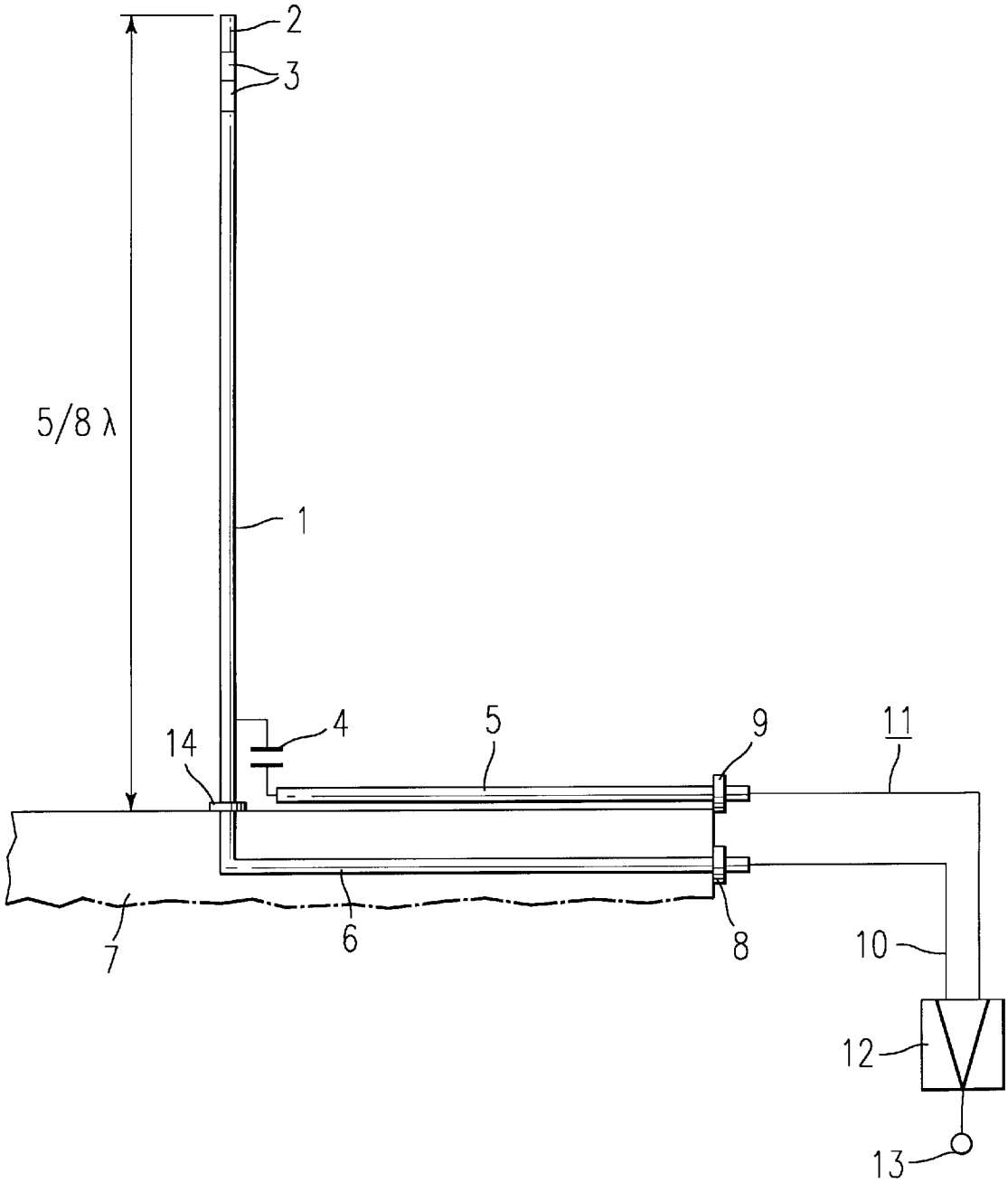
FIG. 1 is an illustration of the antenna arrangement according to the present invention.

The lower of the at least two frequencies is fed to the antenna element 1 via the antenna lead 5 and a capacitor 4, i.e. it is capacitively coupled to the antenna element 1.

The higher of the at least two frequencies is fed directly to the antenna element 1 by means of the antenna lead 6. The feeding of the higher frequency directly into the antenna element 1 is made possible by having the lowest point of the antenna element 1, i.e. where it is attached to the support member 7, at earth potential.

As illustrated in the single figure of the drawings, the length of the antenna element 1 between the support member 7 and the end 2 thereof is ⅝ths of a wavelength, i.e. the wavelength of the lower frequency that the antenna arrangement is adapted to transmit. In practice, the length of the antenna element 1 could be matched to any suitably selected fraction of the wavelength of the lower frequency, for example, ¾ths of the wavelength.

In the following text, an antenna arrangement according to the present invention is described in which the length of the antenna element 1 is ⅝ths of the lower frequency (UHF). As stated above, other choices of antenna length are possible.

The antenna element 1 is in the form of a coaxial waveguide element which is, at least, semi-rigid. By semi-rigid is meant that the antenna element 1 should be able to resist external forces, although a certain amount of deformation of the antenna element due to this effect would be allowable. If any deformation of the antenna element occurs, the return to the original shape could take place either automatically, or manually.

The lower frequency (UHF) is, as stated above, capacitively fed to the antenna element 1 by means of the capacitor 4 which is connected between the antenna element 1 and one end of the antenna lead 5.

Figure 3:
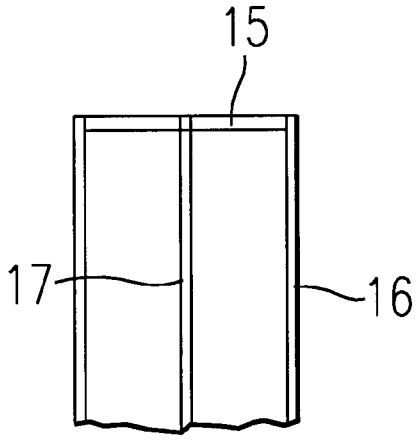
FIG. 3 illustrates the short circuiting element of the present invention.

The antenna element 1 is, as stated above, in the from of a coaxial waveguide element with one end 2 thereof short circuited. FIG. 3 illustrates the short circuiting element 15 which connects the inner and outer conductors of the antenna element 1 to short circuit the antenna element at end 2 thereof. The antenna leads 5 and 6 are also in the form of coaxial waveguide elements.

Figure 2:
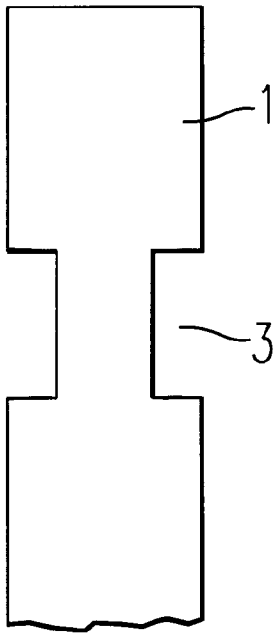
FIG. 2 is an illustration of the slots formed in the antenna element 1 of FIG. 1.

As illustrated in the single figure of the drawings, the coaxial waveguide element 6 is formed integrally with the antenna element 1 to provide a single waveguide unit. The internal structure of this single unit is used as a waveguide for the higher frequencies which are transmitted via a number of slots 3 in the wall of the waveguide forming the antenna element 1. The shape of the slots 3 can be utilized for forming the transmission lobes of the higher frequencies in a desired shape. FIG. 2 is an illustration of these slots 3 formed in the antenna element 1.

The antenna element 1, which is calibrated for a length corresponding to ⅝ths of the wavelength of the lower frequency, is permanently secured to the support member 7 at the mounting 14.

The said at least two frequencies that are to be transmitted by the antenna arrangement according to the present invention are applied to an input terminal 13 which is connected to a device 12 that is adapted to effect separation of the lower and higher frequencies.

The higher and lower frequency outputs of the device 12 are respectively fed to the waveguide lead 6 via a feed line waveguide 10 and a waveguide connector 8, and to the waveguide lead 5 via a feed line waveguide 11 and a waveguide connector 9.

At the transition between the antenna element 1 and the waveguide lead 6, no balun or high-pass filter for the higher frequency is required. The fact that no balun or high-pass filter is required is brought about by the antenna length having been selected as ⅝ths of the lower frequency and the lower frequency being capacitively fed to the antenna element 1, for which reason earth potential is allowed.

The lower frequency output of the device 12 is fed by means of the feed line 11 to the connection 9. The lower frequency is transferred through the coaxial waveguide element 5 to the capacitor 4 which is a capacitive adapter to the lower frequency of the antenna arrangement.

Using the antenna arrangement according to the present invention, it is thus possible to transmit, partly a lower frequency, and partly a number of higher frequencies. The higher frequencies are, as stated above, transmitted via the slots 3 formed in the wall of the waveguide antenna element 1, the slots 3 being matched to the respective higher frequency. The transmission lobes of the higher frequencies can be aligned in dependence on the shape of the slots 3.

We claim:

1. An antenna arrangement for transmitting at least two RF frequencies, comprising:

a waveguide antenna element which is of a length matched to a fraction of the wavelength of the lower of said at least two frequencies, said waveguide antenna element including an internal conductor and at least a shield around said internal conductor;

a short circuit means at one end thereof connecting said internal conductor and said shield; and slots formed in the shield for the transmission of the higher of said at least two frequencies;

first waveguide means for feeding said higher frequency directly to the antenna element at the other end thereof; and second waveguide means for capacitively coupling said lower frequency to the waveguide antenna element, wherein said shield extends to substantially cover the entire length of said internal conductor and acts as a transmitting element.

2. An antenna arrangement as claimed in claim 1, wherein the first waveguide means include a first waveguide feed line for feeding said higher frequency directly to the waveguide antenna element, wherein the first waveguide feed line is formed integrally with the waveguide antenna element to provide a single waveguide unit, and wherein the internal structure of the single waveguide unit is used as a waveguide for the higher frequencies which are transmitted via the slots in the shield.

3. An antenna arrangement for transmitting at least two RF frequencies, comprising:

a waveguide antenna element having a central conductor and an outside shield, said outside shield extending the entire length of said central conductor, said waveguide antenna element being of a length matched to a fraction of the wavelength of the lower of said at least two frequencies;

a short circuit means at one end thereof connecting said outside shield and said central conductor; and slots formed in the outside shield of the waveguide antenna element at said one end thereof, for the transmission of the higher of said at least two frequencies;

first waveguide means, including a first waveguide feed line for feeding said higher frequency directly to the antenna element at the other end thereof, the first waveguide feed line being formed integrally with the waveguide antenna element to provide a single waveguide unit the internal structure of which is used as a waveguide for the higher frequencies which are transmitted via the slots in the outside shield of the waveguide antenna element; and second waveguide means for capacitively coupling said lower frequency to the waveguide antenna element, said second waveguide means including a second waveguide feed line and a capacitor connected between the antenna element and one end of the second waveguide feed line.

4. An antenna arrangement as claimed in either of claims 1 or 3, wherein said other end of the waveguide antenna element is at ground potential.

5. An antenna arrangement as claimed in claim 1 or claim 3, wherein the length of the antenna element is matched to either ¾ths, or ⅝ths of the wavelength of the lower frequency.

6. An antenna arrangement as claimed in claim 1, wherein the antenna element is in the form of a semi-rigid waveguide structure.

7. An antenna arrangement for transmitting at least two RF frequencies, comprising:

a waveguide antenna element having a central conductor and an outside shield, said outside shield extending the entire length of said central conductor, said waveguide antenna element being of a length matched to either ¾ths, or ⅝ths of the wavelength of the lower of said at least two frequencies;

a short circuit means connecting said central conductor and said outside shield at one end thereof, wherein said waveguide antenna element is connected to ground potential at the other end thereof; and slots formed in the outside shield of the waveguide antenna element at said one end thereof, for the transmission of the higher of said at least two frequencies, transmission lobes of the higher frequencies being aligned in accordance with the shape of said slots;

first waveguide means, including a first waveguide feed line for feeding said higher frequency directly to the waveguide antenna element at the other end thereof, the first waveguide feed line being formed integrally with the waveguide antenna element to provide a single waveguide unit the internal structure of which is used as a waveguide for the higher frequencies which are transmitted via the slots in the outside shield of the waveguide antenna element; and second waveguide means for capacitively coupling said lower frequency to the waveguide antenna element, said second waveguide means including a second waveguide feed line and a capacitor connected between the antenna element and one end of the second waveguide feed line.

8. An antenna arrangement as claimed in either of claims 3 or 7, wherein the waveguide antenna element transmits frequencies up to 100 GHz.

9. An antenna arrangement as claimed in claim 8, wherein the higher frequencies are greater than 1 GHz.

* * * * *